US008366402B2

(12) United States Patent
St. Michel et al.

(10) Patent No.: US 8,366,402 B2
(45) Date of Patent: Feb. 5, 2013

(54) SYSTEM AND METHOD FOR DETERMINING ONSET OF FAILURE MODES IN A POSITIVE DISPLACEMENT PUMP

(75) Inventors: Nathan St. Michel, Houston, TX (US); Toshimichi Wago, Houston, TX (US); Joe Hubenschmidt, Sugar Land, TX (US); Jean-Louis Pessin, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 594 days.

(21) Appl. No.: 11/312,124

(22) Filed: Dec. 20, 2005

(65) Prior Publication Data

US 2007/0140869 A1 Jun. 21, 2007

(51) Int. Cl.
*F04B 49/00* (2006.01)
*F04B 49/06* (2006.01)
*G01B 3/44* (2006.01)

(52) U.S. Cl. ..... 417/63; 417/53; 702/34

(58) Field of Classification Search ..... 417/53, 417/63, 297, 454; 702/34
See application file for complete search history.

(56) References Cited

U.S. PATENT DOCUMENTS 2,703,055 A 3/1955 Veth et al.
3,921,435 A * 11/1975 Howard ..... 374/5
4,129,037 A * 12/1978 Toalson ..... 73/152.61
4,456,963 A 6/1984 Wiggins
4,655,077 A 4/1987 Purvis et al.
4,705,459 A * 11/1987 Buisine et al. ..... 417/53
4,866,607 A 9/1989 Anderson et al.
4,915,591 A * 4/1990 Funke ..... 417/18
5,431,186 A 7/1995 Blume
5,540,448 A 7/1996 Heinzen
5,720,598 A * 2/1998 de Chizzelle ..... 417/53
5,846,056 A * 12/1998 Dhindsa et al. ..... 417/44.2
6,003,872 A 12/1999 Nord
6,131,609 A 10/2000 Metso et al.
6,260,004 B1 7/2001 Hays et al.
6,292,757 B1 9/2001 Flanagan et al.
6,485,265 B2 * 11/2002 Schroeder et al. ..... 417/63
6,588,313 B2 7/2003 Brown et al.
6,742,994 B2 6/2004 Hironaka et al.
6,839,660 B2 1/2005 Eryurek et al.
6,945,098 B2 9/2005 Olson
6,970,793 B2 11/2005 Pearson et al.

(Continued)

FOREIGN PATENT DOCUMENTS

EP 0264148 A1 4/1988
GB 2104958 A 3/1983

(Continued)

*Primary Examiner* — Charles Freay
*Assistant Examiner* — Alexander Comley
(74) *Attorney, Agent, or Firm* — Myron Stout; Daryl Wright; Robin Nava

(57) ABSTRACT

A reciprocating pump system is utilized. The system facilitates the prediction of failure modes due to degradation of pump components. A sensor system is used to monitor parameters indicative of abnormal events or wear occurring in specific components, such as pump valves. The indications of wear can be used to predict valve failure or other component failure within the reciprocating pump.

18 Claims, 6 Drawing Sheets

U.S. PATENT DOCUMENTS

| | | | |
|---|---|---|---|
| 7,013,223 | B1 | 3/2006 | Zhang et al. |
| 7,043,975 | B2 | 5/2006 | Du |
| 7,112,892 | B2 | 9/2006 | Mahowald |
| 2004/0117132 | A1 | 6/2004 | Stephenson |
| 2004/0167738 | A1 | 8/2004 | Miller |
| 2006/0054329 | A1 | 3/2006 | Chisholm |
| 2006/0078435 | A1 | 4/2006 | Burza |
| 2006/0228225 | A1 | 10/2006 | Rogers |

FOREIGN PATENT DOCUMENTS

| | | | |
|---|---|---|---|
| WO | WO91/08445 | A1 | 6/1991 |

* cited by examiner

SYSTEM AND METHOD FOR DETERMINING ONSET OF FAILURE MODES IN A POSITIVE DISPLACEMENT PUMP

BACKGROUND

The invention generally relates to a system and method for determining component wear that can lead to failure in a positive displacement pump. The ability to determine component degradation during operation of the pump facilitates prediction of pump failure.

Generally, positive displacement pumps, sometimes referred to as reciprocating pumps, are used to pump fluids in a variety of well applications. For example, a reciprocating pump may be deployed to pump fluid into a wellbore and the surrounding reservoir. The reciprocating pump is powered by a rotating crankshaft which imparts reciprocating motion to the pump. This reciprocating motion is converted to a pumping action for producing the desired fluid.

A given reciprocating pump may comprise one or more pump chambers that each receive a reciprocating plunger. As the plunger is moved in one direction by the rotating crankshaft, fluid is drawn into the pump chamber through a one-way suction valve. Upon reversal of the plunger motion, the suction valve is closed and the fluid is forced outwardly through a discharge valve. The continued reciprocation of the plunger continues the process of drawing fluid into the pump and discharging fluid from the pump. The discharged fluid can be routed through tubing to a desired location, such as into a wellbore.

SUMMARY

The present invention comprises a system and method related to positive displacement pumps. The system and method enable an operator to determine degradation of pump components and potential failure of the positive displacement pump. The system and method also can be used to detect abnormal events that occur during pumping, such as pump cavitation, loss of prime due to, for example, air in the pump, valves stuck in an open or closed position, or debris interfering with valve closure. A sensor system is used to monitor parameters indicative of such abnormal events and/or wear occurring in specific components, such as pump valves. The indications of wear can be used to predict, for example, valve failure within the positive displacement pump.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for providing optimal use of a positive displacement pump deployed, for example, in a well related system. In one aspect, a sensor system is located within the positive displacement pump to detect pump related parameters that can be used to evaluate pump component wear. In the embodiment described herein, the sensor system is used to obtain data on pump related parameters that indicate abnormal events during pumping or degradation of suction valves and/or discharge valves within the pump. The determination of valve wear can be indicative of a failure mode, and the data can be used in predicting failure of the component. Examples of abnormal events that occur during pumping include pump cavitation, loss of prime, valves stuck in an open or closed position, and debris interfering with valve closure.

Figure 1:
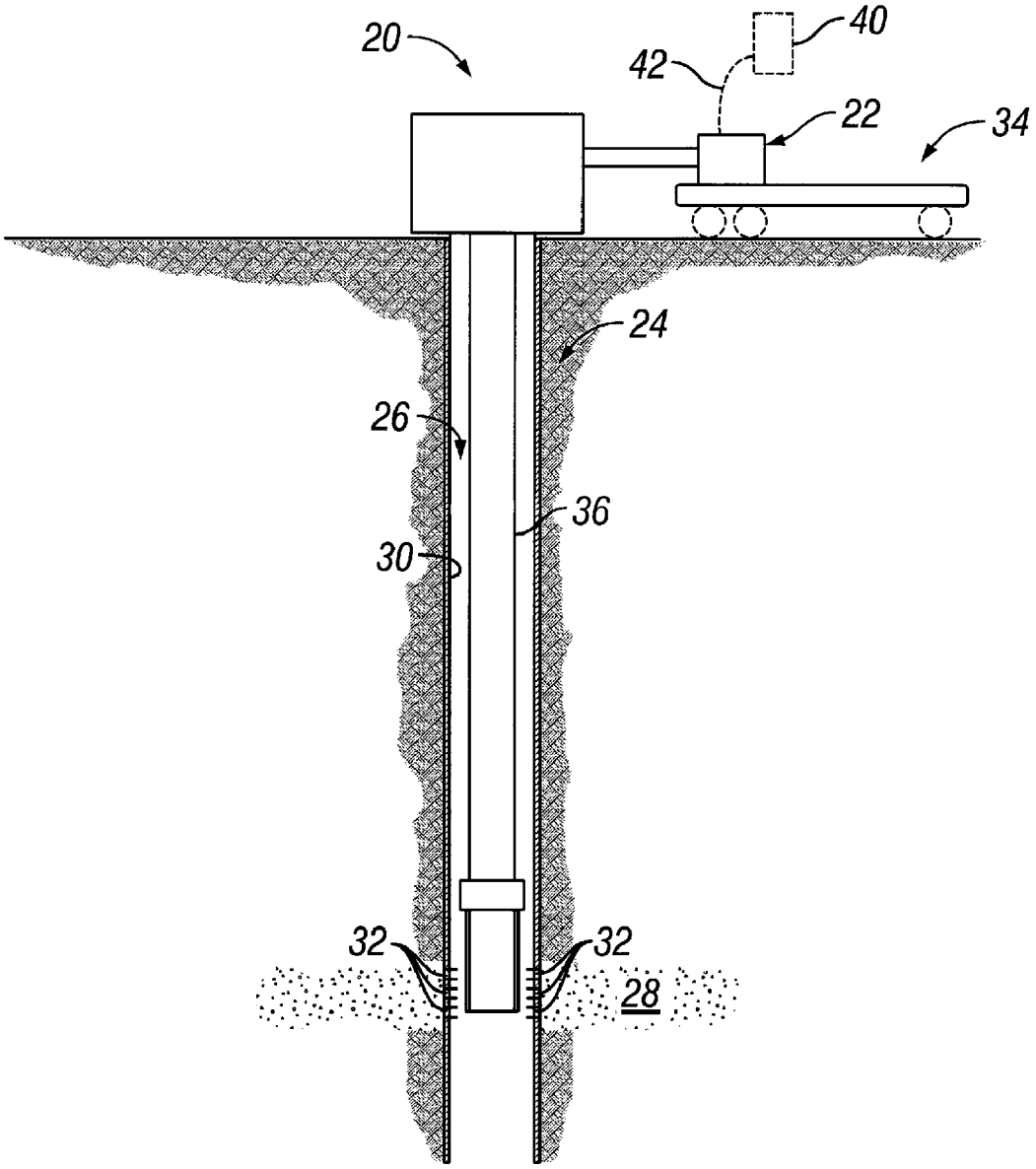
FIG. 1 is a front elevation view of a pumping system deployed for use in a well operation, according to one embodiment of the present invention.

Referring generally to FIG. 1, a system 20 is illustrated for use in a well application, according to one embodiment of the present invention. It should be noted that the present system and method can be used in a variety of applications, however the illustrated well application is used as an example to facilitate explanation. In the illustrated embodiment, the system 20 comprises, for example, a positive displacement pump, i.e. a reciprocating pump, 22 deployed for pumping a fluid into a well 24 having a wellbore 26 drilled into a reservoir 28 containing desirable fluids, such as hydrocarbon based fluids. In many applications, wellbore 26 is lined with a wellbore casing 30 having perforations 32 through which fluids can flow between the wellbore 26 and reservoir 28. Reciprocating pump 22 may be located at a surface location 34, such as on a truck or other vehicle, to pump fluid into wellbore 26 through tubing 36 and out into reservoir 28 through perforations 32. By way of example, the well application may comprise pumping well stimulation fluid into the reservoir for a well stimulation, e.g. pumping a fracturing fluid into the well.

In the embodiment illustrated, positive displacement pump 22 is coupled to a control system 40 by one or more communication lines 42. The communication line 42 can be used to carry signals between positive displacement pump 22 and control system 40. For example, data from sensors located within pump 22 can be output through communication lines 42 for processing on control system 40. The form of communication lines 42 may vary depending on the design of the communication system. For example, the communication system may be formed as a hardwired system in which communication lines 42 are electrical and/or fiber-optic lines. Alternatively, the communication system may comprise a wireless system in which communication lines 42 are wireless and able to provide wireless communication of signals between pump 22 and control system 40.

Figure 2:
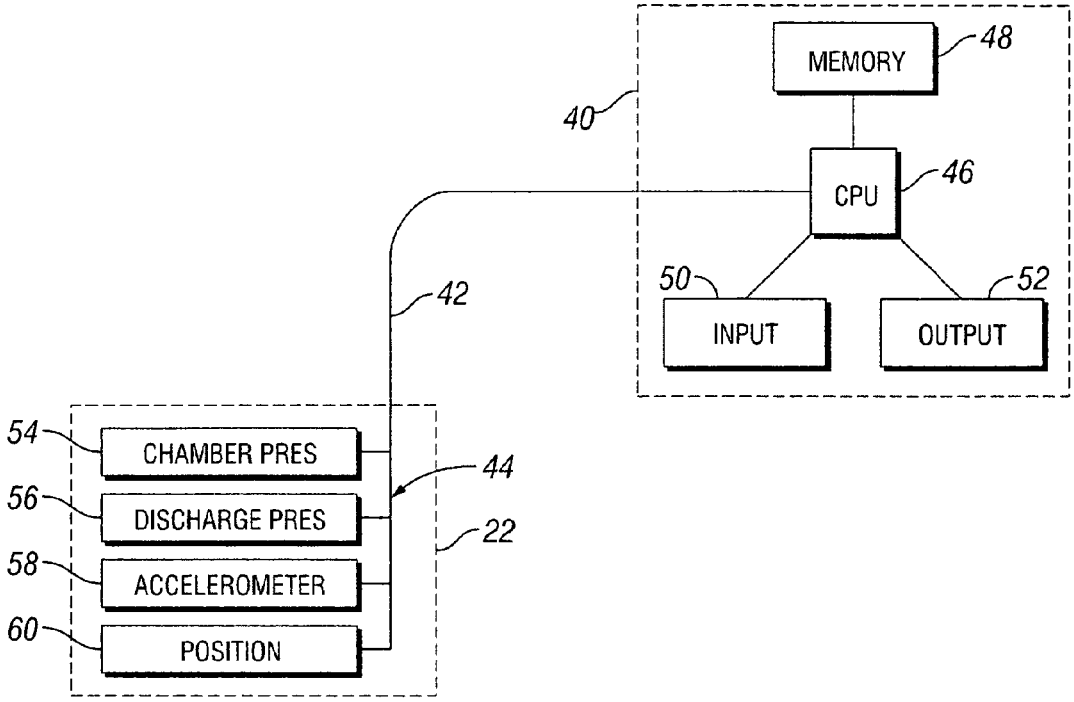
FIG. 2 is a schematic illustration of positive displacement pump sensors coupled to a control system, according to an embodiment of the present invention.

Referring to FIG. 2, control system 40 may be a processor based control system able to process data received from a sensor system 44 deployed within pump 22. By way of example, control system 40 may be a computer-based system having a central processing unit (CPU) 46. CPU 46 is operatively coupled to a memory 48, as well as an input device 50 and an output device 52. Input device 50 may comprise a variety of devices, such as a keyboard, mouse, voice-recognition unit, touchscreen, other input devices, or combinations of such devices. Output device 52 may comprise a visual and/or audio output device, such as a monitor having a graphical user interface. Additionally, the processing may be done on a single device or multiple devices at the well location, away from the well location, or with some devices located at the well and other devices located remotely.

Sensor system 44 is designed to detect specific parameters associated with the operation of positive displacement pump 22. Data related to the specific parameters is output by sensor system 44 through communication line or lines 42 to control system 40 for processing and evaluation. The pump parameter data is used to determine possible failure modes through indications of pump component degradation, e.g. pump valve degradation. The control system 40 also can be used to evaluate and predict an estimated time to failure using techniques, such as data regression. As will be explained more fully below, sensor system 44 may comprise a variety of sensors located within positive displacement pump 22. Examples of such sensors include pump chamber pressure sensors 54, discharge pressure sensors 56, accelerometers 58 and position detectors 60.

Figure 3:
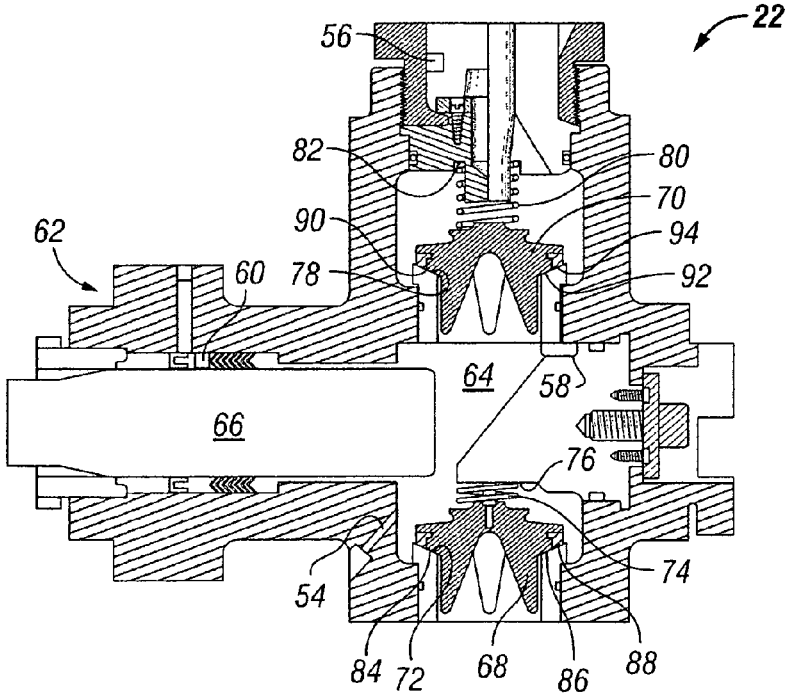
FIG. 3 is a cross-sectional view of a positive displacement pump that can be used in the system illustrated in FIG. 1, according to an embodiment of the present invention.

Positive displacement pump 22 is illustrated in FIG. 3, according to one embodiment of the present invention. As illustrated, pump 22 comprises a pump housing 62 having a pump chamber 64. A plunger 66 is slidably mounted within pump housing 62 for reciprocating motion within pump chamber 64. The reciprocating motion of the plunger acts to change the volume of pump chamber 64. Pump 22 further comprises check valves, such as a suction valve 68 and a discharge valve 70, that control the flow of fluid into pump chamber 64 and out of pump chamber 64, respectively, as plunger 66 reciprocates. The reciprocating motion of the plunger may be generated by a rotating crankshaft (not shown), as known to those of ordinary skill in the art. It should also be noted that a single plunger and a single pump chamber are illustrated to facilitate explanation. However, the single plunger and single pump chamber also are representative of potential additional plungers and pump chambers along with their associated check valves. By way of example, a three chamber, triplex pump can be used in many applications. With a triplex pump or other multiple chamber pumps, the motion of the plungers can be staggered to achieve a more uniform flow of pumped fluids.

Suction valve 68 and a discharge valve 70 are actuated by fluid and spring forces. Suction valve 68, for example, is biased toward a suction valve seat 72, i.e. toward a closed position, by a spring 74 positioned between suction valve 68 and a spring stop 76. Similarly, discharge valve is biased toward a discharge valve seat 78, i.e. toward a closed position, by a discharge valve spring 80 positioned between discharge valve 70 and a spring stop 82. Suction valve 68 further comprises a sealing surface 84 oriented for sealing engagement with valve seat 72. The sealing surface 84 comprises a strike face 86, that may be formed of metal, and a flexible portion 88 that may be formed as a flexible insert. The flexible-portion 88 may be slightly raised relative to strike face 86. Similarly, discharge valve 70 comprises a sealing surface 90 oriented for sealing engagement with valve seat 78. The sealing surface 90 comprises a strike face 92, that may be formed of metal, and a flexible portion 94 that may be formed as a flexible insert. The flexible portion 94 may be slightly raised relative to strike face 92. It should be noted that in some applications, the sealing surfaces 84 and 90 can be formed without flexible portions such that sealing is accomplished with only a metal strike face. The flexible portions 88 and 94 are beneficial for environments in which fluid containing sand or other articles is pumped. However, the flexible portions may not be necessary in applications involving the pumping of relatively "clean" fluids.

When plunger 66 moves outwardly (to the left in FIG. 3), a drop in pressure is created within pump chamber 64. This drop in pressure causes suction valve 68 to move against the bias of spring 74 to an open position and causes fluid to flow into pump chamber 64 through suction valve 68. This phase can be referred to as the "suction stroke." When plunger 66 moves in a reverse direction (to the right in FIG. 3), suction valve 68 is closed by spring 74, and pressure is increased in pump chamber 64. The increase in pressure causes discharge valve 70 to open and forces fluid from pump chamber 64 outwardly through discharge valve 70. The discharge valve 70 remains open while plunger 66 continues to apply pressure to the fluid in pump chamber 64. The high-pressure phase in which fluid is discharged through discharge valve 70 is known as the "discharge stroke."

As each valve is closed, the flexible portion contacts the corresponding seat and is compressed until the strike face of the valve also makes contact with the seat. With suction valve 68, for example, flexible portion 88 is compressed against valve seat 72 until strike face 86 contacts the valve seat. This normally occurs shortly after initiation of the discharge stroke. With discharge valve 70, flexible portion 94 is compressed against valve seat 78 until strike face 92 contacts the valve seat. This normally occurs shortly after initiation of the suction stroke. The deformation of each flexible insert enables the corresponding valve to seal even in fluids containing particles, e.g. cement particles, sand or proppant. However, the abrasive action of such particulates during extended use of the valve causes the flexible portion to degrade, which reduces the ability of the valve to form a seal and ultimately leads to valve failure. If the valves are designed without flexible portions, the metal strike face still can degrade with repeated use.

Sensor system 44 is incorporated into pump 22 to detect parameters within the pump that are indicative of component degradation. In this embodiment, sensor system 44 is used to detect wear on the suction and/or discharge valves through the use of sensors positioned at various locations within the reciprocating, positive discharge pump 22. For example, pump chamber pressure sensor 54 may be positioned for continued exposure to pump chamber 64 to monitor pressure changes within pump chamber 64. Additionally, discharge pressures can be tracked by locating discharge pressure sensor 56 in an area, such as the discharge manifold, which is exposed to the pressure of fluid discharged through discharge valve 70. The closing of suction valve 68 and discharge valve 70 also can be monitored by a variety of sensors, such as one or more accelerometers 58 exposed to pump chamber 64. In many applications, the usefulness of data collected from sensors, such as sensors 54, 56 and 58, is largely dependent on knowing the position of plunger 66. This position can be detected by position sensor 60, e.g. a proximity switch, positioned proximate each plunger 66 at either the top-dead-center or the bottom-dead-center of the plunger stroke.

Figure 4:
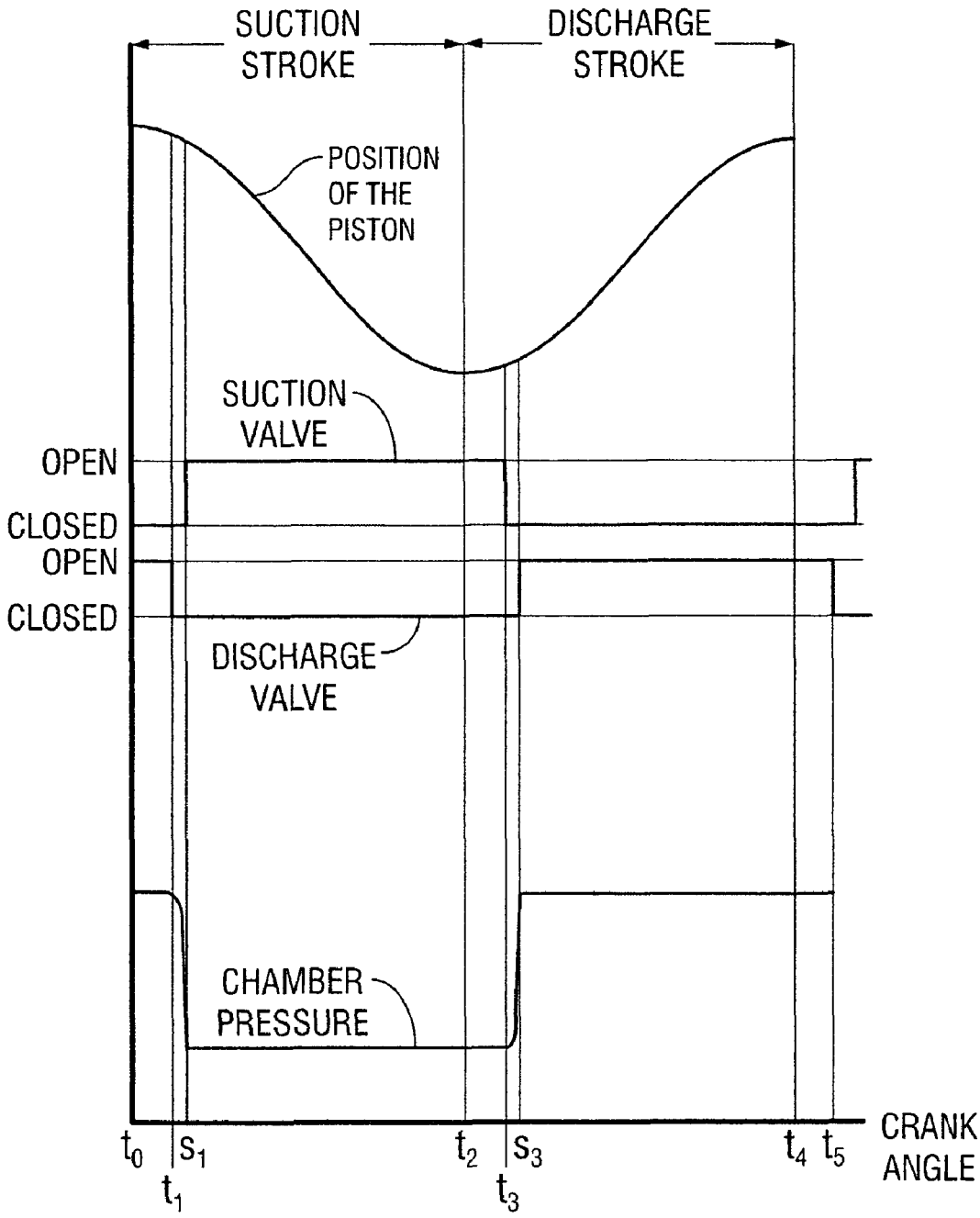
FIG. 4 is a graphical representation of plunger position versus valve state and pump chamber pressure for a positive displacement pump.

Referring generally to FIG. 4, an example of the relationships between plunger position, valve state, and chamber pressure is provided for a given plunger over one complete cycle of the suction stroke and discharge stroke, i.e. one complete revolution of the crank driving plunger 66. In the graphical diagram of FIG. 4, point to is equal to 0°, point $t_3$ is equal to 180°, and point $t_4$ is equal to 360° of the crank revolution and thus the piston movement throughout the suction stroke and the discharge stroke. The plunger 66 begins its outward, or suction, motion at $t_0$. At this time, the discharge valve 70 begins to close, but additional time is required for the discharge valve to fully return and seal against valve seat 78. Complete closure of discharge valve 70 is marked on the graph by $t_1$. Following time $t_1$, pump chamber 64 decompresses to a degree sufficient to open suction valve 68 at a time $s_1$, and the suction valve 68 remains open during the suction stroke, as illustrated in FIG. 4. The suction stroke is completed and the discharge stroke begins at time $t_2$, but additional time is required for the suction valve 68 to fully return and seal against valve seat 72, as marked by time $t_3$ on the graph. Following the suction valve closure time marked $t_3$, the pressure in pump chamber 64 rises to a degree sufficient to open discharge valve 70 at time $s_3$. The discharge valve 70 remains open through the discharge stroke which is completed at time $t_4$, and the discharge valve closes after a time lag to $t_5$.

Valve degradation can be determined by monitoring pump parameters, e.g. pump chamber pressure, that indicate changes in the relative timing of events within pump 22, e.g. changes in the time lag to achieve sealing of the suction valve 68 and/or discharge valve 70 relative to plunger position. Other pump parameters also can be used to determine changes in the relative timing of events as an alternative to chamber pressure and/or to verify the data provided by the chamber pressure sensor 54. For example, the relative timing can be established and verified by monitoring overall discharge pressure of the pump 22, the pressure inside each pump chamber 64, the crank position via position sensor 60, and the closing of the valves by accelerometers 58, as explained below.

Figure 5:
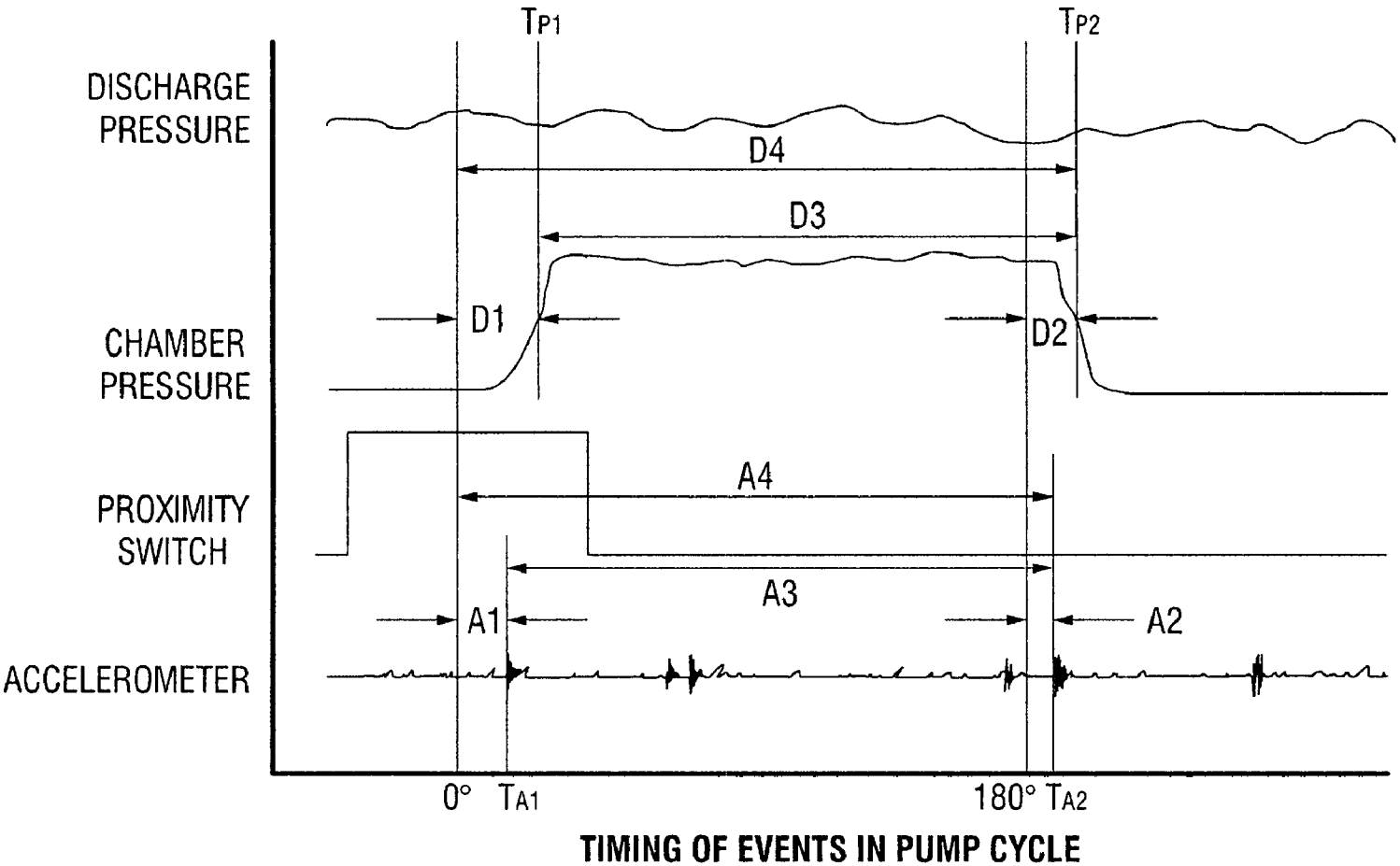
FIG. 5 is a graphical representation of pump parameters detected over time within a positive displacement pump, according to an embodiment of the present invention.

In FIG. 5, a sequence of events is illustrated for a single pump stroke. The sequence of events includes events revealed by the output from pump chamber pressure sensor 54, discharge pressure sensor 56, accelerometer 58, and position sensor 60. In this example, position sensor 60 comprises a proximity switch positioned to identify the plunger position at bottom-dead-center. On the graphs of FIG. 5, bottom-dead-center of plunger 66 is identified as the point midway between the edges of the plunger proximity switch pulse, and this point is labeled 0°. The accelerometer 58 indicates the next event as the sound of suction valve 68 closing at point Ta1 to the right of the 0° mark. The pressure in pump chamber 64 then rises (see chamber pressure graph on FIG. 5) as the fluid is compressed by plunger 66 until it reaches the same level as the discharge pressure (indicated on the top graph in FIG. 5). At this point, the discharge valve 70 opens and the pump chamber pressure matches the discharge pressure. Following the 180° mark representing the transition from the discharge stroke to the suction stroke, the accelerometer signal indicates the closing of discharge valve 70 at point Ta2. Subsequently, the pressure in pump chamber 64 begins to drop and continues to drop, causing the suction valve 68 to open once again.

The measurements marked A1, A2, A3, and A4 all can be used to measure the time lag between the 0° and 180° points in the pump cycle and the actual time of the valve closings. For example, measurement A1 reflects the time lag between the bottom-dead-center/0° mark and the closing of suction valve 68, and measurement A2 reflects the time lag between the end of the discharge stroke and the closing of discharge valve 70. The measurements A3 and A4, between points Ta1 and Ta2 and between the 0° mark and point Ta2, respectively, also can be used to determine the time lags and any changes in the timing of the valve closures relative to the position of plunger 66.

The relative timing information also can be obtained from the chamber pressure waveforms as illustrated by the chamber pressure graph of FIG. 5. For example, the transition to the actual discharge phase can be identified in several ways based on the chamber pressure waveform. For example, the transition can be identified by using the point of deviation from the low-pressure suction regime, the point at which the chamber pressure signal equals the discharge pressure signal, or the point at which the chamber pressure signal reaches approximately 50% of the discharge pressure. The latter option is illustrated in FIG. 5, and the transition point established by this method is labeled Tp1. The same approach can be used to determine the point of transition to the actual suction phase, and that point is labeled Tp2 on the chamber pressure waveform of FIG. 5. With this approach, the measurements marked D1, D2, D3, and D4 all can be used to determine the time lag between the 0° and 180° points in the pump cycle and the actual timing of the valve closings. For example, measurement D1 reflects the time lag between the bottom-dead-center/0° mark and the closing of suction valve 68, and measurement D2 reflects the time lag between the end of the discharge stroke and the closing of discharge valve 70. The measurements D3, between points Tp1 and Tp2, and D4, between the 0° mark and point Tp2, also can be used to determine the time lags and any changes in the timing of the valve closures relative to the position of plunger 66. The values D1 and A1, for example, are referred to as the "suction lag," and the values D2 and A2 are referred to as the "discharge lag."

As suction valve 68 or discharge valve 70 tends to wear due to, for example, degradation of flexible portion 88 or flexible portion 94, the corresponding time lag tends to increase. Specifically, the suction lag increases as suction valve 68 degrades, and the discharge lag increases as discharge valve 70 degrades. Upon failure of a valve, the corresponding lag becomes a relatively extreme value. As described above, control system 40 in conjunction with sensor system 44 provides a detection system, e.g. a computer-based data monitoring system, able to determine any changes in suction lag and/or discharge lag for each pump chamber within positive displacement pump 22. The control system 40 also can use the acquired sensor data and degradation analysis to predict the occurrence of valve failure. For example, the control system 40 can be used to run a standard data regression program on accumulated data to provide an estimated time to failure. Furthermore, a computer-based control system enables the use of absolute values for the lag of each valve or the creation of a relative measurement between the valves.

Figure 6:
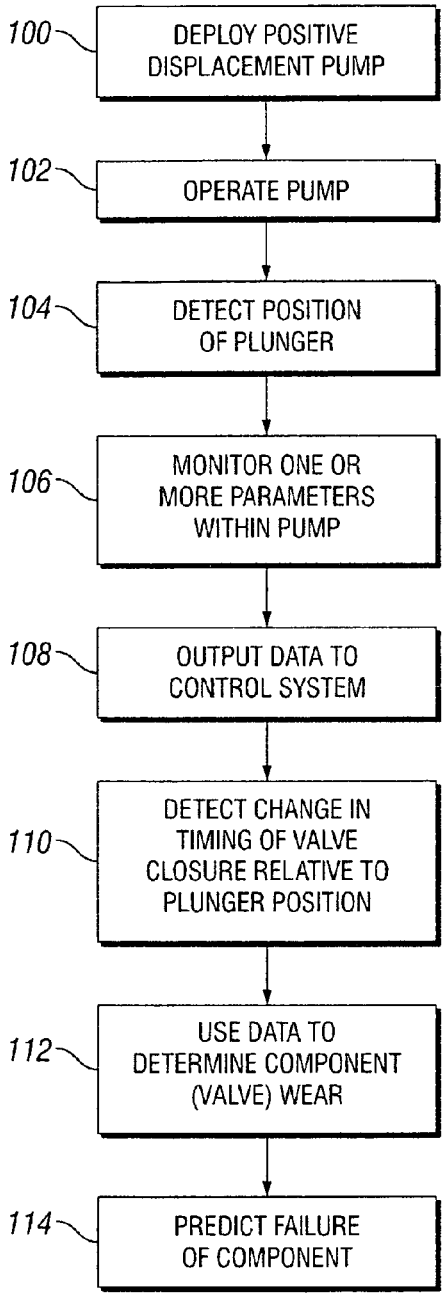
FIG. 6 is a flowchart illustrating a methodology for determining failure modes, according to an embodiment of the present invention.
Figure 7:
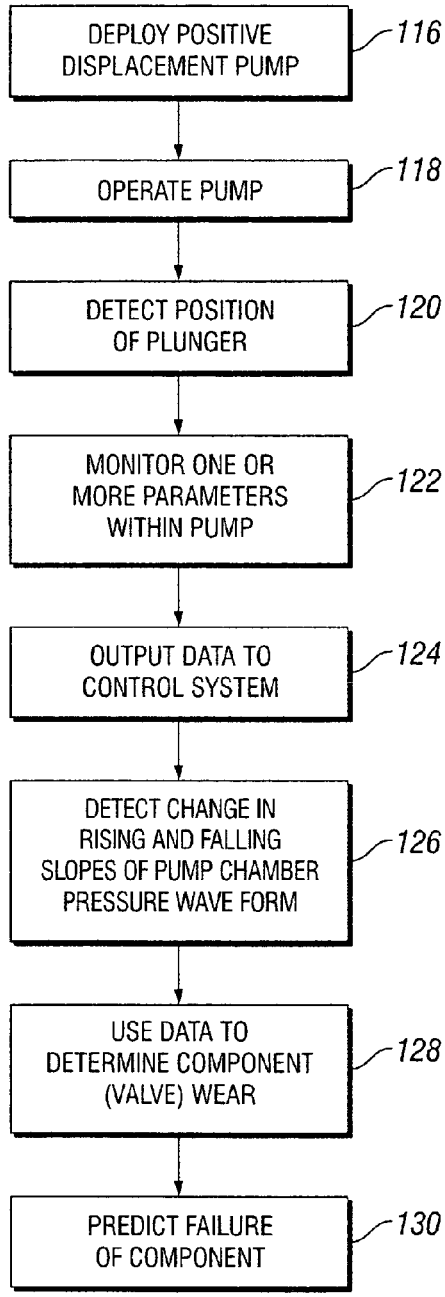
FIG. 7 is a flowchart illustrating an alternate methodology for determining failure modes, according to another embodiment of the present invention.
Figure 8:
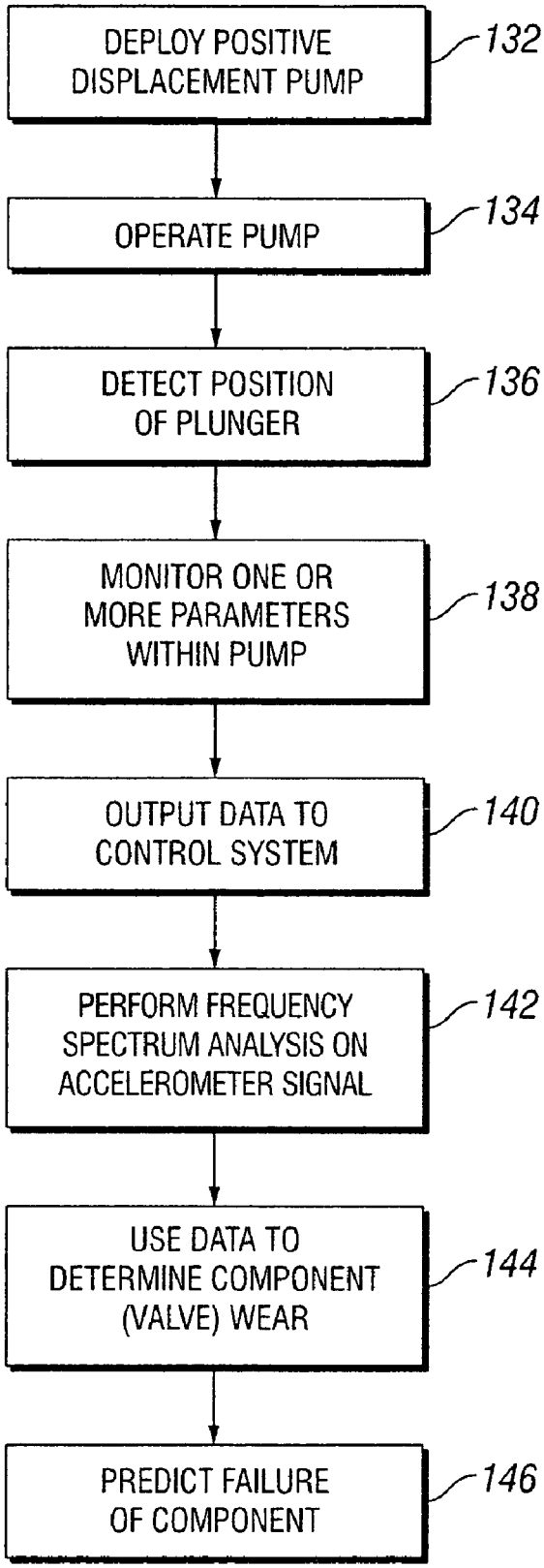
FIG. 8 is a flowchart illustrating an alternate methodology for determining failure modes, according to another embodiment of the present invention.

Embodiments of overall methodologies for determining component degradation and predicting component failure are illustrated in the flowcharts of FIGS. 6-8. As illustrated in FIG. 6, positive displacement pump 22 is initially deployed, as indicated by block 100. In a fracturing operation, for example, the pump can be a mobile truck-based pump used in well stimulation. The pump is then operated to move a fluid to a desired location, e.g. a wellbore location for introduction of fluid into a reservoir, as illustrated by block 102. As the pump is operated, the position of plunger 66 is detected and monitored, as illustrated by block 104. Additionally, one or more pump parameters that can be used as indicators of component wear within pump 22 are detected on an ongoing basis, as illustrated by block 106. The pump parameters can be tracked by sensors, such as pump chamber pressure sensors 54, valve closure sensors 58, and discharge pressure sensors 56. The data collected from the sensors is output to control system 40, as indicated by block 108, and a control system 40 is able to process the data to detect changes in the timing of valve closure relative to plunger position, as illustrated by block 110, and as described above. The changes in timing of valve closure can be used to determine valve degradation and/or the occurrence of abnormal events during pumping, as illustrated by block 112. Furthermore, the changes in timing and the degradation of a given valve can be used by control system 40 to predict failure of the component through prediction techniques, such as a data regression calculation, as illustrated by block 114. In the fracturing example discussed above, valve degradation may occur after several frac jobs, so the pump parameters are tracked throughout consecutive frac jobs.

An alternative embodiment is illustrated in the flowchart of FIG. 7. This alternative embodiment is similar to the embodiment described with reference to FIG. 6 in that a positive displacement pump is initially deployed, as illustrated by block 116, and operated, as illustrated by block 118. The position of plunger 66 also is detected and monitored, as illustrated by block 120, while monitoring one or more pump parameters, including pump chamber pressure within the pump, as illustrated by block 122. The data collected by the sensors also is output to control system 40, as illustrated by block 124. However, in this embodiment, control system 40 is used to detect changes in the rising and/or falling slopes of a pump chamber pressure waveform created with data provided by pump chamber pressure sensor 54, as illustrated by block 126. Changes in the rising and falling slopes of the pump chamber pressure waveform can be used as an indication of valve wear, as illustrated by block 128. Also, the data collected on valve wear can be used to predict a time of failure for the component, as illustrated by block 130.

Another alternative embodiment is illustrated in the flowchart of FIG. 8. This alternative embodiment also is similar to the embodiment described with reference to FIG. 6. For example, a positive displacement pump is initially deployed, as illustrated by block 132. The positive displacement pump is operated, as illustrated by block 134, and the position of plunger 66 is detected on an ongoing basis, as illustrated by block 136. Simultaneously, one or more pump parameters, including pump valve closure detected with an accelerometer or other valve closure sensor, is monitored, as illustrated by block 138. The data collected by the sensors is again output to control system 40, as illustrated by block 140. However, in this embodiment, control system 40 is used to perform frequency spectrum analyses on a signal from the valve closure sensor, e.g. an accelerometer signal, as illustrated by block 142. The frequency spectrum analyses are used to detect changes in, for example, the accelerometer signal indicative of valve degradation, as illustrated by block 144. Changes in the frequency spectrum are tracked over time, and the changes are used to predict a time of failure for the component, as illustrated by block 146.

As described above, a plurality of pump parameters detected within a positive displacement pump can be used individually or in combination to determine indications of pump component degradation. It should be noted that different types of sensors can be used in pump 22, and those sensors can be located at a variety of locations within the pump depending on, for example, pump design, well environment and sensor capability. Additionally, the sensor or sensors may be deployed in pumps having a single pump chamber or in pumps having a plurality of pump chambers to provide data for determining degradation of valves associated with each pump chamber.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method, comprising:

monitoring a pump chamber pressure in a pump chamber of a positive displacement pump;

detecting a plunger position within the pump chamber of the positive displacement pump;

determining at least one of a suction lag corresponding to a suction valve and a discharge lag corresponding to a discharge valve;

measuring a discharge pressure of the positive displacement pump;

determining the at least one of the suction lag in response to at least one of D1 and A1, wherein D1 reflects a time difference between an event marking the detection of a bottom-dead-center plunger position and a subsequent event marking the pump chamber pressure being equal to at least one-half of the discharge pressure, and wherein A1 reflects a time difference between the event marking the detection of a bottom-dead-center plunger position and another event marking the detection of closing the suction valve;

outputting at least one of the suction lag and the discharge lag to a control system and accumulating data relating to said pump chamber pressure, said plunger position, and said at least one of the suction lag and the discharge lag over consecutive operations of the positive displacement pump; and, running a regression program on said accumulated data to provide an estimated time to failure for one of the suction valve and the discharge valve.

2. The method as recited in claim 1, wherein monitoring comprises monitoring pump chamber pressures within a plurality of pump chambers within the positive displacement pump.

3. The method as recited in claim 1, wherein determining comprises determining the closing time of the suction valve and the discharge valve with at least one accelerometer positioned in the positive displacement pump.

4. The method as recited in claim 1, further comprising processing the data to determine any parameter timing changes indicative of future failure of the at least one of the suction valve and the discharge valve.

5. The method as recited in claim 1, further comprising processing the data to determine any changes in rising and falling slopes of a pump chamber pressure waveform indicative of future failure of the at least one of the suction valve and the discharge valve.

6. The method as recited in claim 1, further comprising processing the data to perform frequency spectrum analyses on an accelerometer signal to determine changes in the frequency spectrum over time.

7. The method as recited in claim 1, further comprising determining the at least one of the suction lag and the discharge lag in response to the pump chamber pressure being equal to the discharge pressure.

8. The method as recited in claim 1, further comprising determining the at least one of the suction lag and the discharge lag in response to the pump chamber pressure being equal to at least one-half of the discharge pressure.

9. The method as recited in claim 1, further comprising determining the suction lag in response to determining a point of deviation of the pump chamber pressure from a low-pressure suction scheme.

10. The method as recited in claim 1, further comprising determining the discharge lag in response to determining a point of deviation of the pump chamber pressure to a low-pressure suction scheme.

11. The method as recited in claim 2, further comprising tracking the at least one of the suction lag and the discharge lag over several consecutive pumping jobs.

12. The method as recited in claim 11, wherein the pumping jobs comprise frac jobs.

13. The method as recited in claim 2, further comprising determining a plurality of suction lag values corresponding to each of the pump chambers.

14. The method as recited in claim 2, further comprising determining a plurality of discharge lag values corresponding to each of the pump chambers.

15. The method as recited in claim 1, wherein said method is for pumping well stimulation fluid into a reservoir for a well stimulation.

16. The method as recited in claim 1, further comprising determining the at least one of the discharge lag in response to at least one of D2 and A2, wherein D2 reflects a time difference between an event marking the detection of a top-dead-center plunger position and a subsequent event marking the pump chamber pressure being equal to at least one-half of the discharge pressure; and wherein A2 reflects a time difference between the event marking the detection of a top-dead-center plunger position and another event marking the detection of closing the discharge valve.

17. A method, comprising:

monitoring a pump chamber pressure in a pump chamber of a positive displacement pump;

detecting a plunger position within the pump chamber of the positive displacement pump;

determining at least one of a suction lag corresponding to a suction valve and a discharge lag corresponding to a discharge valve;

measuring a discharge pressure of the positive displacement pump;

determining the at least one of the discharge lag in response to at least one of D2 and A2, wherein D2 reflects a time difference between an event marking the detection of a top-dead-center plunger position and a subsequent event marking the pump chamber pressure being equal to at least one-half of the discharge pressure; and wherein A2 reflects a time difference between the event marking the detection of a top-dead-center plunger position and another event marking the detection of closing the discharge valve;

outputting at least one of the suction lag and the discharge lag to a control system and accumulating data relating to said pump chamber pressure, said plunger position, and said at least one of the suction lag and the discharge lag over consecutive operations of the positive displacement pump; and, running a regression program on said accumulated data to provide an estimated time to failure for one of the suction valve and the discharge valve.

18. The method as recited in claim 17, further comprising determining the at least one of the suction lag in response to at least one of D1 and A1, wherein D1 reflects a time difference between an event marking the detection of a bottom-dead-center plunger position and a subsequent event marking the pump chamber pressure being equal to at least one-half of the discharge pressure; and wherein A1 reflects a time difference between the event marking the detection of a bottom-dead-center plunger position and another event marking the detection of closing the suction valve.

* * * * *